US011267539B2

(12) United States Patent
Fafard et al.

(10) Patent No.: US 11,267,539 B2
(45) **Date of Patent: *Mar. 8, 2022**

(54) RECONFIGURABLE SEATING FOR WATERCRAFT

(71) Applicant: Chaparral Boats, Inc., Nashville, GA (US)

(72) Inventors: Michael J. Fafard, Nashville, GA (US); Gerren Shea Smith, Alapaha, GA (US); Dale Norris Exum, Nashville, GA (US)

(73) Assignee: Chaparral Boats, Inc., Nashville, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/007,406

(22) Filed: Aug. 31, 2020

(65) Prior Publication Data

US 2020/0398944 A1 Dec. 24, 2020

Related U.S. Application Data

(63) Continuation of application No. 15/699,244, filed on Sep. 8, 2017, now Pat. No. 10,759,502.

(60) Provisional application No. 62/458,894, filed on Feb. 14, 2017.

(51) Int. Cl.
*B63B 29/04* (2006.01)

(52) U.S. Cl.
CPC ..... *B63B 29/04* (2013.01); *B63B 2029/043* (2013.01)

(58) Field of Classification Search
CPC ..... B63B 29/04
USPC ..... 297/1, 3, 244
See application file for complete search history.

(56) References Cited

U.S. PATENT DOCUMENTS

| | | | |
|---|---|---|---|
| 425,483 | A | 4/1890 | Arnold |
| 2,969,107 | A | 1/1961 | Wiliam |
| 3,107,940 | A | 10/1963 | Brooks |
| 3,379,471 | A | 4/1968 | Dalziel |
| 9,021,975 | B1 | 5/2015 | Fodor |
| 9,073,608 | B1 | 7/2015 | Foss |
| 9,315,238 | B2 | 4/2016 | Neese |
| 9,370,245 | B2 | 6/2016 | Fafard |
| 10,494,061 | B2 | 12/2019 | Fafard et al. |
| 10,759,502 | B2 | 9/2020 | Fafard et al. |
| 2018/0229816 | A1 | 8/2018 | Fafard et al. |
| 2018/0229817 | A1 | 8/2018 | Fafard et al. |

*Primary Examiner* — Anthony D Barfield
(74) *Attorney, Agent, or Firm* — Fish & Richardson P.C.

(57) ABSTRACT

Boats can include seating assemblies that can be configured in a variety of different arrangements. In one configuration of the seating assemblies described herein, a forward-facing seat and a rearward-facing seat are arranged back-to-back above a seat bottom. In another configuration, the seating assembly can be arranged as a forward-facing reclined seat such that a forward rotation of the forward-facing seat to a flat position with the seat bottom causes a rearward rotation of the rearward-facing seat to a reclined position. In still another configuration, the seating assembly can be configured form a reclined seat in a rearward-facing configuration.

19 Claims, 11 Drawing Sheets

RECONFIGURABLE SEATING FOR WATERCRAFT

CROSS-REFERENCE TO RELATED APPLICATIONS

This application is a continuation of U.S. patent application Ser. No. 15/699,244, filed Sep. 8, 2017, titled "RECONFIGURABLE SEATING FOR WATERCRAFT", now allowed as U.S. Pat. No. 10,759,502, which claims the benefit under 35 U.S.C. § 119(e) of U.S. Patent Application No. 62/458,894, entitled "RECONFIGURABLE SEATING FOR WATERCRAFT," filed Feb. 14, 2017. The disclosures of the foregoing applications are incorporated herein by reference in their entirety for all purposes.

BACKGROUND

This document relates to seating assemblies for boats. For example, this document relates to seating assemblies that can be configured in a variety of different arrangements.

Recreational boating is a popular leisure activity in the United States. More than 87 million U.S. adults participated in recreational boating in 2014, using a boat for sports activities such as fishing and water skiing, and/or to travel. These boats are classified into several categories: sailboats, personal watercrafts, stemdrive boats, inboard boats, and outboard boats.

SUMMARY

This document describes seating assemblies for boats. For example, this document describes seating assemblies that can be configured in a variety of different arrangements. In one seating assembly configuration described herein, a forward-facing seat and a rearward-facing seat are arranged back-to-back. In another configuration, the seating assembly can be arranged as an essentially flat surface that can serve, for example, as an expansive sun bathing platform. In still another configuration, the seating assembly can be configured in a comfortable lounging arrangement that can be forward-facing or rearward-facing.

In one aspect, this disclosure is directed to a watercraft seating assembly. The watercraft seating assembly includes a seat bottom including an upper seating surface, and multiple seat back members that are reconfigurable between (i) forming back-to-back seats and (ii) forming a substantially flat surface. The multiple seat back members include a first seat back member movable in relation to the seat bottom and a second seat back member movable in relation to the seat bottom. While the multiple seat back members are forming the back-to-back seats, the first seat back member has a first seat back surface facing forward and a second seat back surface facing rearward. While the multiple seat back members are forming the back-to-back seats, the second seat back member has a third seat back surface facing forward and a fourth seat back surface facing rearward. While the multiple seat back members are forming the substantially flat surface, the upper seating surface, the second seat back surface, and the third seat back surface each comprise portions of the substantially flat surface.

Such a watercraft seating assembly may optionally include one or more of the following features. While the seating assembly is forming the substantially flat surface, the upper seating surface may be between the second seat back surface and the third seat back surface. While the seating assembly is forming the back-to-back seats, the second seat back surface may face the third seat back surface. The first seat back member and the second seat back member may be movable in relation to the seat bottom independently of each other. The first seat back member and the second seat back member may be each pivotable in relation to the seat bottom. While the seating assembly is forming the back-to-back seats, a forward portion of the upper seating surface and the first seat back surface may form a forward-facing seat, and a rearward portion of the upper seating surface and the fourth seat back surface may form a rearward-facing seat. The forward-facing seat and the rearward-facing seat each accommodate at least three seated passengers. The seating assembly may be configurable in a forward-facing lounge seat arrangement in which: (i) a forward portion of the upper seating surface and the second seat back surface comprise a substantially flat lounge seat surface and (ii) the third seat back surface comprises a lounge seat back. The seating assembly may be configurable in a rearward-facing lounge seat arrangement in which: (i) a rearward portion of the upper seating surface and the third seat back surface comprise a substantially flat lounge seat surface and (ii) the second seat back surface comprises a lounge seat back.

In another aspect, this disclosure is directed to a watercraft seating assembly. The watercraft seating assembly includes: (i) a seat bottom member; (ii) a first seat back member movable relative to the seat bottom member; and (iii) a second seat back member movable relative to the seat bottom member. The seating assembly is configurable in a substantially flat configuration in which the seat bottom member is disposed between the first and second seat back members. The seating assembly is also configurable as two back-to-back seats, each seat comprising a portion of the seat bottom member and either the first seat back member or the second seat back member.

Such a watercraft seating assembly may optionally include one or more of the following features. The seating assembly may be reconfigurable from the substantially flat configuration to the back-to-back seats configuration by pivoting the first and second seat back members toward each other. The first and second seat back members may each pivot at least 60 degrees when reconfiguring from the substantially flat configuration to the back-to-back seats configuration. The seating assembly may be reconfigurable from the back-to-back seats configuration to the substantially flat configuration by pivoting the first and second seat back members away from each other. The first and second seat back members may each pivot at least 60 degrees when reconfiguring from the back-to-back seats configuration to the substantially flat configuration.

In another aspect, this disclosure is directed to a watercraft that includes a deck and a seating assembly attached to the deck. The seating assembly includes: (a) a seat bottom member; (b) a first seat back member movable relative to the seat bottom member; and (c) a second seat back member movable relative to the seat bottom member. The seating assembly is configurable in a substantially flat configuration in which the seat bottom member is disposed between the first and second seat back members. The seating assembly is also configurable as two back-to-back seats, each seat having a portion of the seat bottom member and either the first seat back member or the second seat back member.

Such a watercraft may optionally include one or more of the following features. The two back-to-back seats may comprise a first seat that faces toward a front of the watercraft and a second seat that faces toward a rear of the watercraft. The seating assembly may extend laterally across a majority of a beam of the watercraft. One or more storage compartments may reside under the seat bottom member and above the deck. The watercraft may also include: one or more first motorized actuators that pivot the first seat back member when the seating assembly is reconfiguring between the back-to-back seats configuration and the substantially flat configuration; and one or more second motorized actuators that pivot the second seat back member when the seating assembly is reconfiguring between the back-to-back seats configuration and the substantially flat configuration. The first and second seat back members may each pivot at least 75 degrees when reconfiguring between the back-to-back seats configuration and the substantially flat configuration.

Particular embodiments of the subject matter described in this document can be implemented to realize one or more of the following advantages. First, in some implementations the seating assemblies described herein are highly versatile. As such, the seating assemblies can advantageously provide utility and enjoyment in a variety of circumstances. For example, the seating assemblies described herein can be configured as back-to-back seats, a sun bathing platform, and as lounge seating. Hence, the seating can be configured in a multitude of differing arrangements, however the user desires.

Second, in some embodiments the seating assemblies described herein can be constructed to have whatever width a user desires and/or whatever is suitable for a particular watercraft. Accordingly, the seating assemblies can be designed for a single occupant or for multiple occupants. In some embodiments, the seating assemblies can be constructed to laterally span a majority of, or even all of, a boat's beam distance.

Third, in some embodiments the seating assemblies described herein can be designed to facilitate storage under or within the seating assembly. In some embodiments, drawers under the seating assembly can be included. In particular embodiments, the seat bottom, or a portion thereof, can be movable to provide access to one or more storage areas incorporated into the seating assembly.

In yet another aspect, this document describes seating assemblies that can be configured to move between a forward-facing seat and a rearward-facing seat arranged back-to-back and a reclined seating arrangement where the forward-facing seat is rotated to form an extended seat bottom and the rearward-facing seat reclines away from the forward-facing seat. In some embodiments, the seating assembly includes a front and back seat member, where, in the back-to-back configuration each of the front and back seat members form one of the forward-facing seat and the rearward-facing seat along with a seat bottom extending below both seat members. The front and back seat member are pivotably connected to a support assembly that links movement of the front seat member with movement of the back seat member, such that when the either seat member is moved from the back-to-back configuration into the reclined configuration, the other seat member moves as well. In some examples, to move to the reclined seating arrangement, the front seat member moves from a substantially vertical position in the back-to-back configuration to a positional aligned with the seat bottom to form an extended platform. Movement of the front seat member to this substantially vertical position causes the rear seat member to move away from the front seat member and into a reclined position, such that the rear seat member defines an acute seating angle with respect to the seat bottom.

In one aspect, this disclosure is related to a watercraft seating assembly having a seat bottom including an upper seating surface and multiple seat back members that are reconfigurable between (i) an upright configuration forming back-to-back seats and (ii) a reclined configuration forming a reclined seat. The multiple seat back members include a first seat back member movable in relation to the seat bottom and a second seat back member movable in relation to the seat bottom. When the multiple seat back members are forming the back-to-back seats, the first seat back member has a first seat back surface facing forward and a second seat back surface facing rearward. When the multiple seat back members are forming the back-to-back seats, the second seat back member has a third seat back surface facing forward and a fourth seat back surface facing rearward. And when the multiple seat back members are forming the reclined seat, the upper seating surface and the second seat back surface each include portions of the substantially flat surface, and the third seat back surface is arranged in a reclined position with respect to the substantially flat surface.

In some examples, while the seating assembly is forming the reclined seat, the third seat back surface defines an obtuse angle with respect to the second seat back surface and the upper seating surface.

In some examples, wherein, while the seating assembly is forming the back-to-back seats, the second seat back surface faces the third seat back surface.

In some examples, wherein the first seat back member and the second seat back member are coupled together by a support assembly, such that movement of the first seat back member from the upright configuration to the reclined configuration causes a corresponding movement of the second seat back member from the upright configuration to the reclined configuration.

In some examples, wherein the support assembly includes a (i) support structure, (ii) a first support attached to the first seat back member and pivotally coupled to the support structure at a first point, (iii) a second support attached to the second seat back member and pivotally coupled to the support structure at a second point, (iv) a first linkage having a first end coupled to the first support at a location offset from first point such that rotation of the first support about the first point rotates the first end in an arc around the first point, (v) a second linkage having a first end coupled to the second support at a location offset from the second point such that rotation of the second support about the second point rotates the first end in an arc around the second point, and (vi) a third linkage pivotally coupled to the support structure at a third point and including a first end coupled to a second end of the first linkage and a second end coupled to a second end of the second linkage, such rotation the first support about the first points causes rotation of the third linkage about the third point and rotation of the second support about the second point.

In some examples, the support structure of the support assembly includes a first slot through which the first linkage is coupled to the first support structure and a second slot through which the second linkage is coupled to the second support structure. The first slot defines the arc around the first point traveled by the first end of the first linkage the second slot defines the arc around the second point traveled by the first end of the second linkage. A first end of the first slot defines a stop corresponding to the upright location of the first seat back member and a second end of the first slot defines a stop corresponding to the flat location of the first seat back member. A first end of the second slot defines a stop corresponding to the upright location of the second seat back member and a second end of the slot defines a stop corresponding to the reclined location of the second seat back member. In some examples, the support structure of the support assembly includes a third slot though which a pin coupled one of the first, second, and third linkages travels during movement of the first and second support back members.

In some examples, in the upright configuration the first and second seat back members are in a substantially vertical position, and wherein, in the reclined configuration, the first seat back member is aligned with the upper seating surface and the second seat back member is angled away from the first seat back member. In some examples, in the reclined configuration, the first second seat back surface is aligned with the upper seating surface and the third seat back surface defines an obtuse angle with respect to a portion of the upper seating surface between the first seat back member and the second seat back member.

In some examples, movement of the first seat back member from the upright configuration to the reclined configuration includes a rotation of a first degree, and wherein movement of the second seat back member from the upright position to the reclined configuration comprises a rotation of a second degree, the second degree being less than the first degree. In some examples, the first degree of rotation is at least 60 degrees, and wherein the second degree of rotation is less than 90 degrees. In some examples, the first degree of rotation is about 90 degrees, and wherein the second degree of rotation is less than 75 degrees.

In some examples, while the seating assembly is in the upright configuration, a forward portion of the upper seating surface and the first seat back surface form a forward-facing seat, and a rearward portion of the upper seating surface and the fourth seat back surface form a rearward-facing seat. In some examples, the forward-facing seat and the rearward-facing seat each accommodate at least three seated passengers.

Yet another aspect of the disclosure is a watercraft seating assembly including a seat bottom member, a first seat back member movable relative to the seat bottom member between an upright position and a flat position, a second seat back member movable relative to the seat bottom member between an upright position and a reclined position, and a support assembly linkage moveably coupling the first seat back member to the second seat back member. When the first seat back member is in the upright position the second seat back member is the upright position, and when the first position is in the flat position the second seat back member is in the reclined positioned, and when the first seat back member moves between the upright and the flat positions the second seat back member moves between the upright and the reclined positions. The seating assembly is configurable in the upright positions as two back-to-back seats each having a portion of the seat bottom member and either the first seat back member or the second seat back member and wherein the seating assembly is configurable in a reclined configuration as a reclined seat in which the first seat back member is aligned with the seat bottom in the flat position and the second seat back member is reclined away from the first seat back member in the reclined position.

In some examples, the flat position of the first seat back member is substantially aligned with the seat bottom member, and wherein the reclined position of the second seat back member defines an obtuse angle with respect to the seat bottom member.

In some examples, the first seat back member pivots at least 60 degrees between the upright position and the flat position, and wherein the second seat back member pivots less than the first seat back member between the upright position and the reclined position.

In some examples, the seating assembly is reconfigurable from the back-to-back seats configuration to the reclined configuration by pivoting either of the first and second seat back members away from the other.

Still yet another aspect of the present disclosure is a watercraft having a deck and a seating assembly attached to the deck. The seating assembly includes a seat bottom member, a first seat back member movable relative to the seat bottom member between an upright position and a flat position, a second seat back member movable relative to the seat bottom member between an upright position and a reclined position, and a support assembly linkage moveably coupling the first seat back member to the second seat back member such that when the first seat back member is in the upright position the second seat back member is the upright position, and when the first position is in the flat position the second seat back member is in the reclined positioned, and when the first seat back member moves between the upright and the flat positions the second seat back member moves between the upright and the reclined positions. When the seating assembly is configurable in the upright positions as two back-to-back seats each forming a seat with portion of the seat bottom member and either the first seat back member or the second seat back member and wherein the seating assembly is configurable in a reclined configuration as a reclined seat in which the first seat back member is aligned with the seat bottom in the flat position and the second seat back member is reclined away from the first seat back member in the reclined position.

In some examples, the two back-to-back seats comprise a first seat that faces toward a front of the watercraft and a second seat that faces toward a rear of the watercraft. In some examples, the seating assembly extends laterally across a majority of a beam of the watercraft.

In some examples, the seating assembly includes one or more first motorized actuators operatively coupled to the support assembly linkage and configured to pivot the first and second seat back members between the upright positions the reclined configuration.

Other features, objects, and advantages of the invention will be apparent from the description and drawings, and from the claims.

The details of one or more embodiments of the invention are set forth in the accompanying drawings and the description herein.

Although methods and materials similar or equivalent to those described herein can be used to practice the invention, suitable methods and materials are described herein. In case of conflict, the present specification, including definitions, will control. In addition, the materials, methods, and examples are illustrative only and not intended to be limiting.

DESCRIPTION OF THE DRAWINGS

Like reference numbers represent corresponding parts throughout.

DETAILED DESCRIPTION

This document describes seating assemblies for boats. For example, this document describes seating assemblies that can be configured in a variety of different arrangements. In one seating assembly configuration described herein, a forward-facing seat and a rearward-facing seat are arranged back-to-back. In another configuration, the seating assembly can be arranged as an essentially flat surface that can serve, for example, as an expansive sun bathing platform. In still another configuration, the seating assembly can be configured in a comfortable lounging arrangement that can be forward-facing or rearward-facing.

Figure 1:
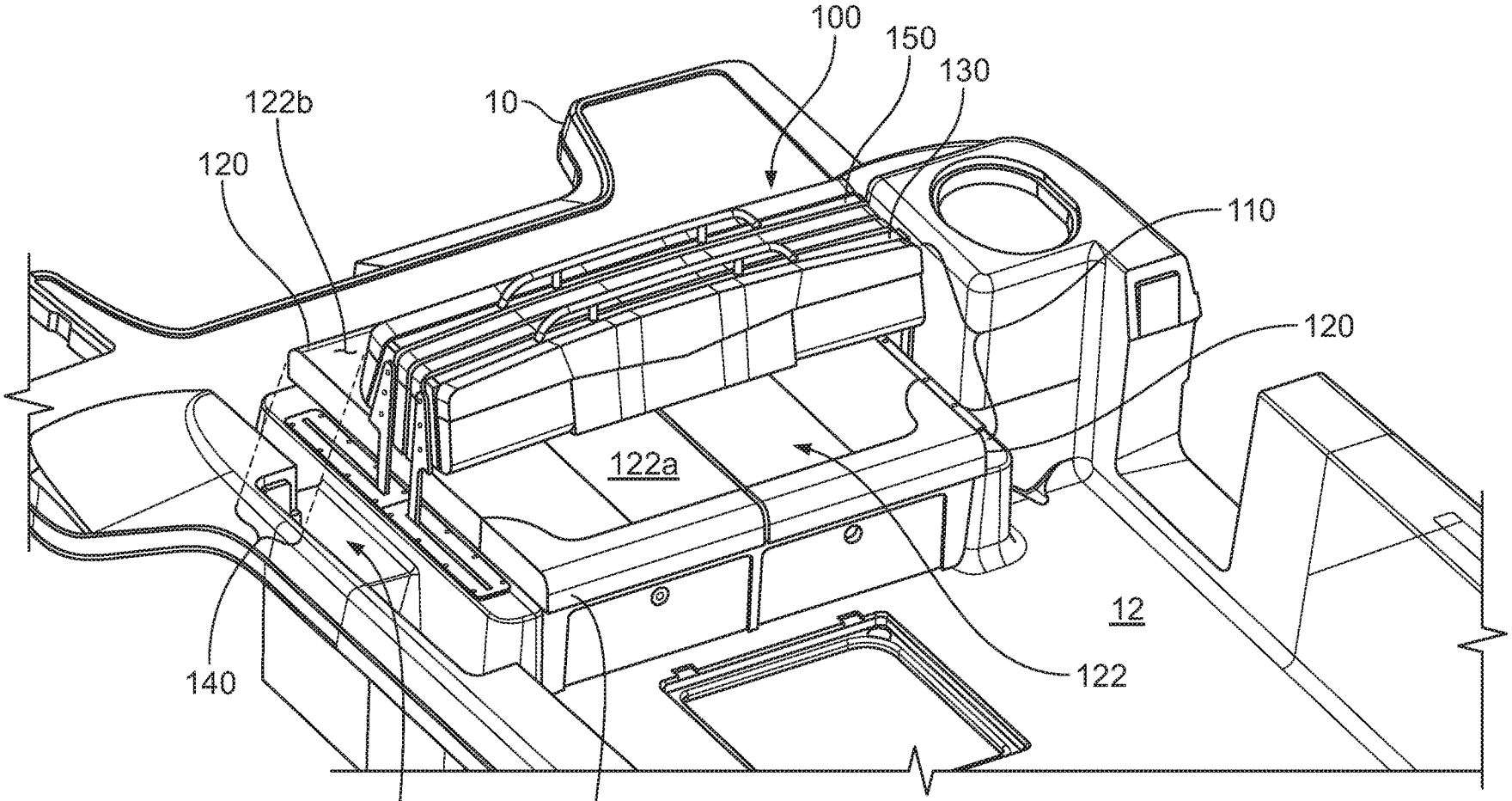
FIG. 1 is a perspective view of a boat-mounted seating assembly in accordance with some embodiments. The seating assembly is configured as back-to-back seats.

Referring to FIG. 1, a boat 10 can include an example seating assembly 100.

In the depicted implementation, the seating assembly 100 is attached to a deck 12 of the boat 10 in a rear portion of the boat 10. The seating assembly 100 can be used in a variety of different types of boats (e.g., runabouts, pontoon boats, ski boats, sailboats, bow riders, inboards, outboards, inboard/outboards, jet-boats, yachts, houseboats, and the like). While the seating assembly 100 is shown in the rear (aft area) area of the boat 10, the seating assembly 100 can also be used in other areas of a watercraft (middle areas, front areas, cabin areas, and the like). The seating assembly 100 can be cushioned, covered with water-resistance covering materials, and can include or facilitate various other amenities (e.g., cup holders, contours, hand-holds, seat belts, and so on) as suitable for the particular implementation and the user's desires.

In the depicted embodiment, the seating assembly 100 laterally spans a majority of the beam (width) of the boat 10. A walkway 14 can be provided along the side of the seating assembly 100 in some embodiments (on either the port side or starboard side). In some embodiments, a walkway is provided along a longitudinal middle portion of the boat 10 such that two seating assemblies 100 are positioned laterally across the boat 10 with a fore-aft walkway in between the two seating assemblies 100. In some embodiments, the seating assembly 100 spans essentially an entirety of the beam of the boat 10.

The seating assembly 100 can be constructed in a variety of widths. In some embodiments, the width of the seating assembly 100 accommodates a single occupant. In the depicted embodiment, the seating assembly is wide enough to accommodate about three or four occupants side-by-side. It should be understood that the seating assembly 100 can be constructed to have any suitable width, e.g., to accommodate one, two, three, four, five, six, seven, eight, or more than eight occupants side-by-side.

The seating assembly 100 can be configured in multiple arrangements. In the depicted configuration, the seating assembly 100 is configured as a forward-facing seat 110 and a rearward-facing seat 140 that are arranged back-to-back. Hence, one or more occupants can be seated in the forward-facing seat 110 and one or more additional occupants can be seated in the rearward-facing seat 140, simultaneously if so desired.

The seating assembly 100 includes a seat bottom 120, a first seat back member 130, and a second seat back member 150. As described further below, the first seat back member 130 is movable in relation to the seat bottom 120. In addition, the second seat back member 150 is movable in relation to the seat bottom 120. Moreover, the first seat back member 130 is movable independently from movement of the second seat back member 150. That is, the first seat back member 130 can be moved while the second seat back member 150 is maintained in a stationary location (in relation to the seat bottom 120). Similarly, the second seat back member 150 can be moved while the first seat back member 130 is maintained in a stationary location (in relation to the seat bottom 120). In addition, if so desired, the first seat back member 130 and the second seat back member 150 can be moved simultaneously (in relation to the seat bottom 120).

The seat bottom 120 includes an upper seating surface 122. In particular, the seat bottom 120 includes a forward portion of the upper seating surface 122*a* and a rearward portion of the upper seating surface 122*b*. The forward portion of the upper seating surface 122*a* forms the forward-facing seat 110 along with the first seat back member 130. The rearward portion of the upper seating surface 122*b* forms the rearward-facing seat 140 along with the second seat back member 150.

In the depicted configuration, the first seat back member 130 and the second seat back member 150 are both located in their full upright positions such that the seating assembly 100 forms the back-to-back seats 110 and 140. From there, the first seat back member 130 can be moved forward and downward, and the second seat back member 150 can be moved rearward and downward. By moving the first seat back member 130 and/or the second seat back member 150 to particular locations, a variety of different seating configurations can be attained, as described further below.

Figure 2:
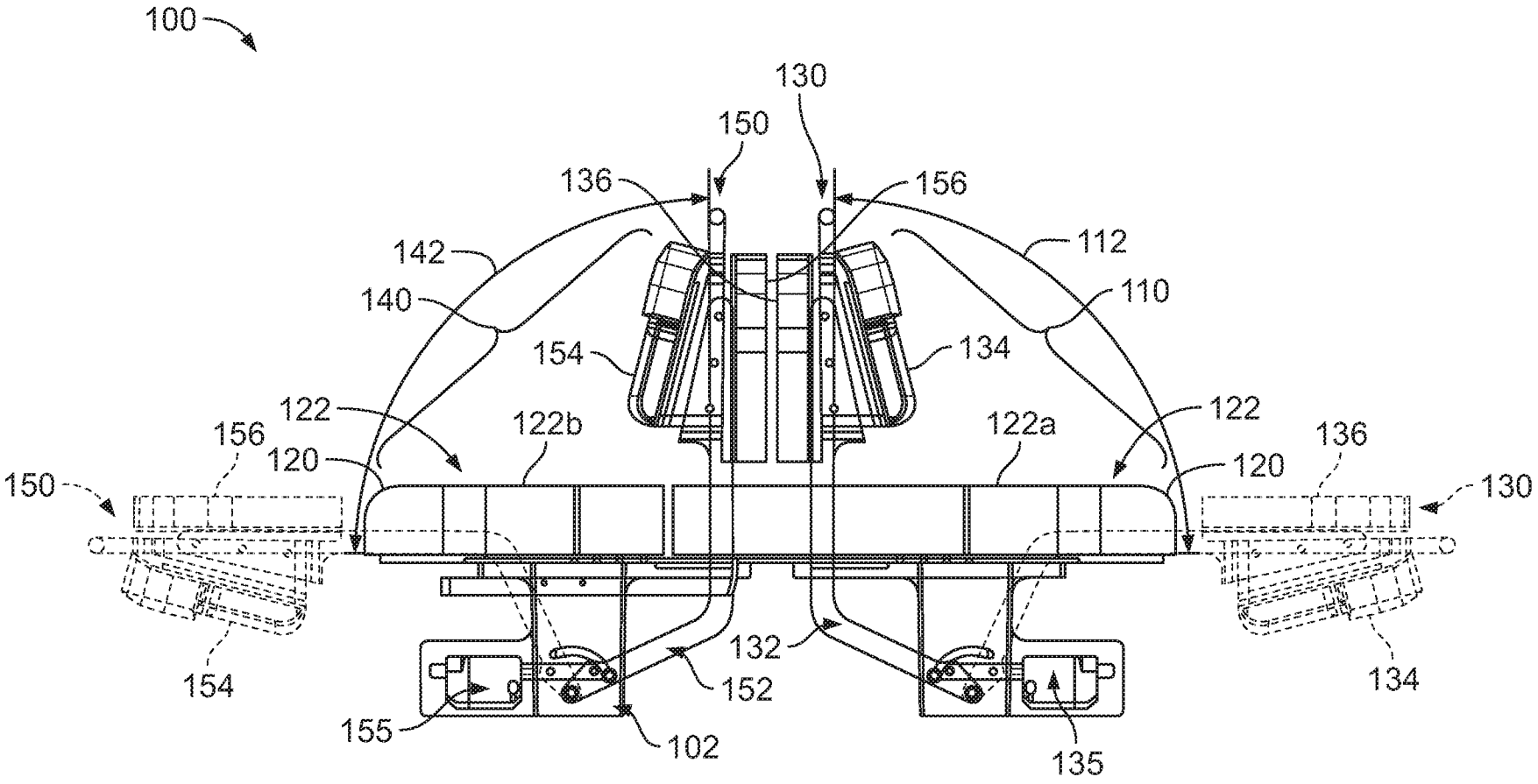
FIG. 2 is a side view of the seating assembly of FIG. 1. The seat backs are shown in two different positions (fully upright and pivoted fully downward).

Referring to FIG. 2, in the depicted embodiment the first seat back member 130 and the second seat back member 150 can be individually pivoted between the fully upright positions (as shown in solid lines) and the fully downward positions (as shown in broken lines). In addition, in the depicted embodiment the first seat back member 130 and the second seat back member 150 can be individually detained, held, or secured in any desired location along their paths of travel between the fully upright positions and the fully downward positions.

In the depicted embodiment, the first seat back member 130 and the second seat back member 150 are individually pivotable in relation to the seat bottom 120. In particular, the first seat back member 130 can be pivoted in relation to the seat bottom 120 to sweep through an angle 112 (and/or portions of the angle 112), and the second seat back member 150 can be pivoted in relation to the seat bottom 120 to sweep through an angle 142 (and/or portions of the angle 142). In some embodiments, the seat back member 130 and 150 can be positioned stationary and detained for use at any location along the sweep angles 112 and 142.

In the depicted embodiment, the angles 112 and 142 are about 90 degrees. In some embodiments, the angles 112 and/or 142 in a range of about 85 degrees to about 95 degrees, or about 80 degrees to about 100 degrees, or about 70 degrees to about 110 degrees, or about 60 degrees to about 120 degrees, or about 70 degrees to about 90 degrees, or about 60 degrees to about 80 degrees, or about 50 degrees to about 70 degrees, without limitation.

The movements of the first seat back member 130 are driven by one or more actuators 135. The movements of the second seat back member 150 are driven by one or more actuators 155. In the depicted embodiment, the actuators 135 and 155 are electric motor driven linear actuators. In some embodiments, other types of actuators can be used such as, but not limited to, rotary actuators, hydraulic actuators, gear motors, and the like. In the depicted embodiment, there are two actuators 135 (one on each side of the first seat back member 130) and two actuators 155 (one on each side of the second seat back member 150). In some embodiments, a single actuator 135 and/or 155 is used for a respective seat back member 130 and/or 150.

User-control of the actuators 135 and 155 can be facilitated using various types of user interface controls. In some embodiments, one or more switches (e.g., push buttons, toggle switches, and the like) can be located on a nearby bulkhead or other portion of the boat 10. In some embodiments, the one or more switches can be located at the cockpit area of the boat 10. In particular embodiments, a wired or wireless remote control unit can be used to actuate movements of the seat back members 130 and 150. In some embodiments, particular configurations of the seating assembly 100 can be stored in memory and, in response to a single button push, the seating assembly 100 will move the first seat back member 130 and/or the second seat back member 150 as needed to attain the particular configurations.

While in the depicted embodiment, the first seat back member 130 and the second seat back member 150 are pivotable in relation to the seat bottom 120, in some embodiments the first seat back member 130 and/or the second seat back member 150 can be movable in other ways. For example, in some embodiments the first seat back member 130 and/or the second seat back member 150 can be translated along (moved along) a track, detached and then reattached in the desired location, or otherwise movable.

The seating assembly 100 includes a base 102. The base 102 supports the seating portions of the seating assembly 100, and mounts the seating assembly 100 to the deck 12 (FIG. 1). In some embodiments, the base 102 is constructed of materials such as, but not limited to, stainless steel (e.g., SAE 316, etc.), aluminum, plated steel, composite materials, and the like, and combinations thereof.

In some embodiments, the base 102 is designed to facilitate space for storage under the seat bottom 120. For example, in the depicted embodiment one or more drawers are located under the forward portion of the upper seating surface 122*a*, and the rearward portion of the upper seating surface 122*b* can be pivoted to access storage space there below.

The first seat back member 130 and the second seat back member 150 include arms 132 and 152 respectively. The arms 132 and 152 are pivotably linked to the one or more actuators 135 and 155 respectively. The arms 132 and 152 mechanically support the other portions of the first seat back member 130 and the second seat back member 150, and facilitate the movements of the first seat back member 130 and the second seat back member 150 in relation to the seat bottom 120. In some embodiments, the arms 132 and 152 are constructed of materials such as, but not limited to, stainless steel (e.g., SAE 316, etc.), aluminum, plated steel, composite materials, and the like, and combinations thereof.

The first seat back member 130 includes a first seat back surface 134 that faces forward while the seating assembly 100 is configured as back-to-back seats (as shown in FIG. 2) and a second seat back surface 136 that faces rearward while the seating assembly 100 is configured as back-to-back seats. The second seat back member 150 includes a third seat back surface 156 that faces forward while the seating assembly 100 is configured as back-to-back seats (as shown in FIG. 2) and a fourth seat back surface 154 that faces rearward while the seating assembly 100 is configured as back-to-back seats.

When the seating assembly 100 is configured as back-to-back seats, the first seat back surface 134 and the forward portion of the upper seating surface 122*a* comprise the forward-facing seat 110. Also when the seating assembly 100 is configured as back-to-back seats, the fourth seat back surface 154 and the rearward portion of the upper seating surface 122*b* comprise the rearward-facing seat 140.

As depicted by the broken lines in FIG. 2, when the seating assembly 100 is configured as a substantially flat surface, the upper seating surface 122, the second seat back surface 136, and the third seat back surface 156 make up portions of the substantially flat surface.

Figure 3:
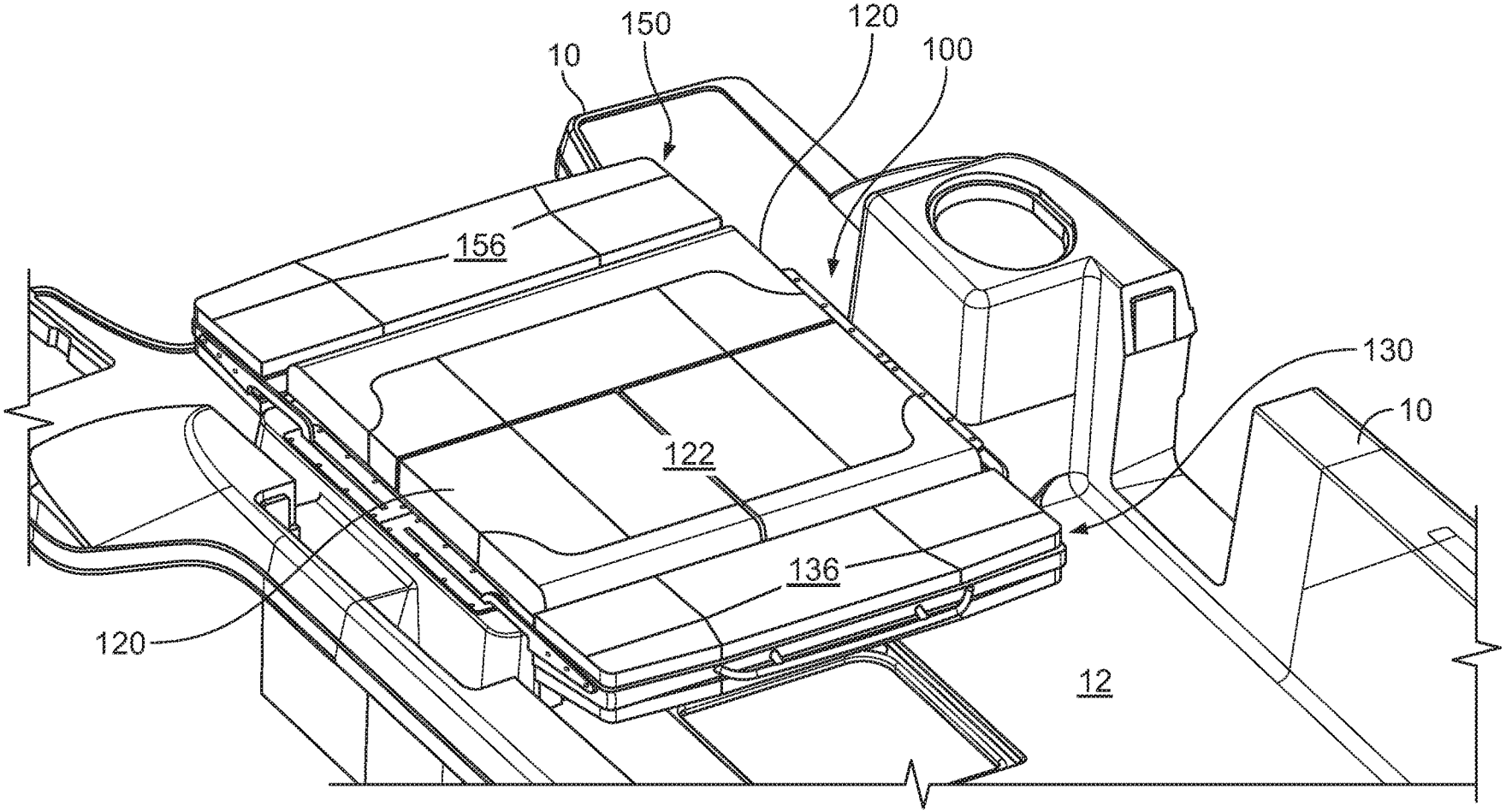
FIG. 3 is another perspective view of the boat-mounted seating assembly of FIG. 1. The seating assembly is configured as a substantially flat surface for sun bathing.

Referring to FIG. 3, the seating assembly 100 can be configured as a substantially flat surface. Such a configuration can be desirable for sun bathing for example.

In the substantially flat surface configuration, the first seat back member 130 and the second seat back member 150 are pivoted fully downward. In result, the second seat back surface 136 is substantially coplanar with the upper seating surface 122, and the third seat back surface 156 is substantially coplanar with the upper seating surface 122.

If the user desires, one or both of the first seat back member 130 and the second seat back member 150 can be pivoted upward a little (e.g., about 5-10 degrees) to provide slight elevation for a comfortable headrest, or a footrest. In one such example, the first seat back member 130 can be pivoted upward about 10 degrees to provide a pillow-like headrest for occupants who are laying on the seating assembly 100 with their feet at the rearward end of the seating assembly 100 (i.e., near the third seat back surface 156).

Figure 4:
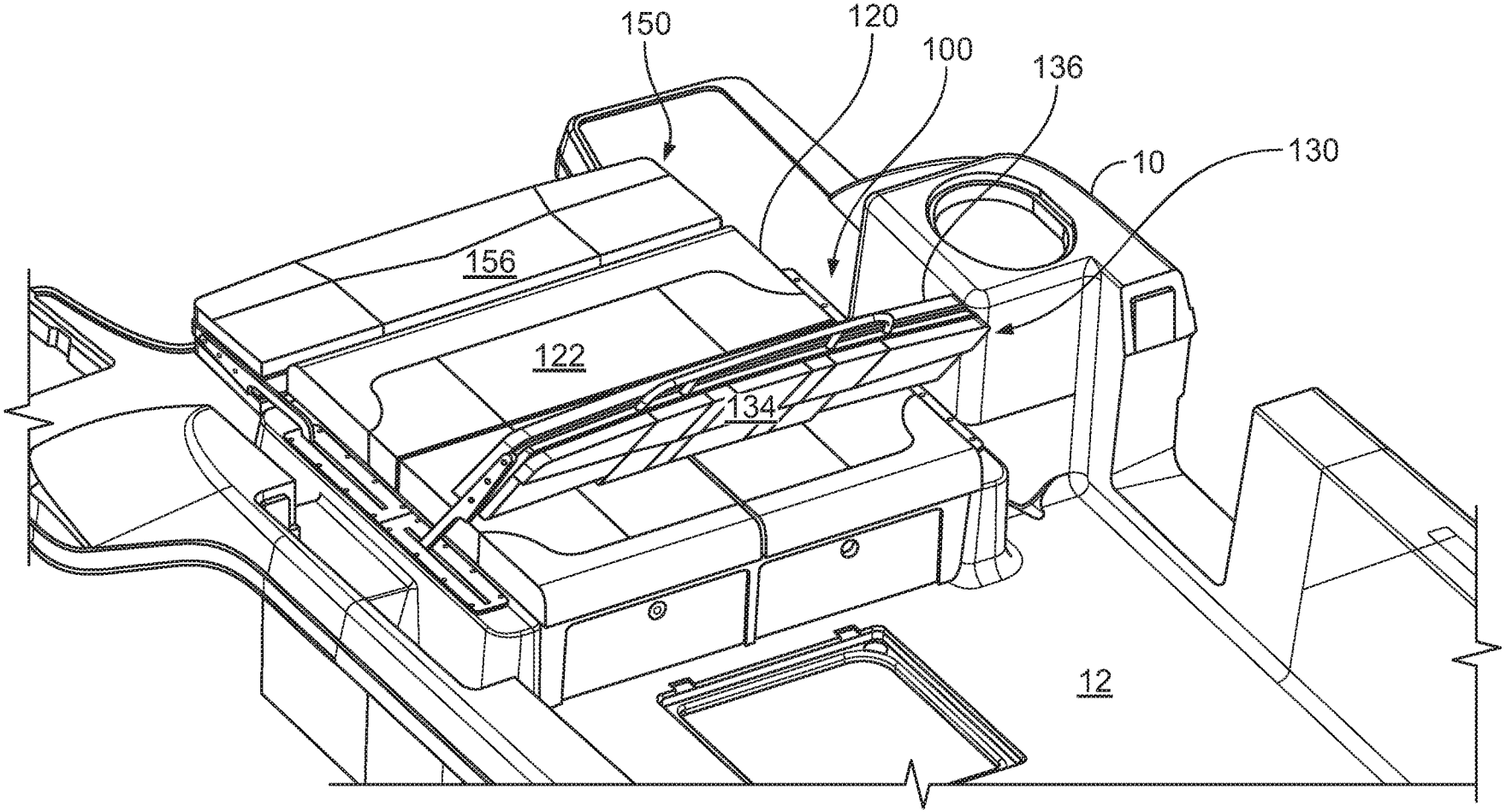
FIG. 4 is another perspective view of the boat-mounted seating assembly of FIG. 1. The seating assembly is configured as a rearward-facing lounge seat arrangement.

Referring to FIG. 4, the seating assembly 100 can also be configured as a rearward-facing lounge seat arrangement. In the rearward-facing lounge seat arrangement, the first seat back member 130 is pivoted partially upward to provide a reclined backrest, and the second seat back member 150 is pivoted fully downward.

The third seat back surface 156 and the upper seating surface 122 of the seat bottom 120 make up portions of a substantially planar surface. The second seat back surface 136 provides the reclined backrest surface. It should be understood that the first seat back member 130 can be pivoted to, and detained in, any desired location in relation to the seat bottom 120. Similarly, if the occupant(s) desires to elevate the feet area, the second seat back member 150 can be pivoted upward a little (e.g., about 5-10 degrees) to provide slight elevation.

Figure 5:
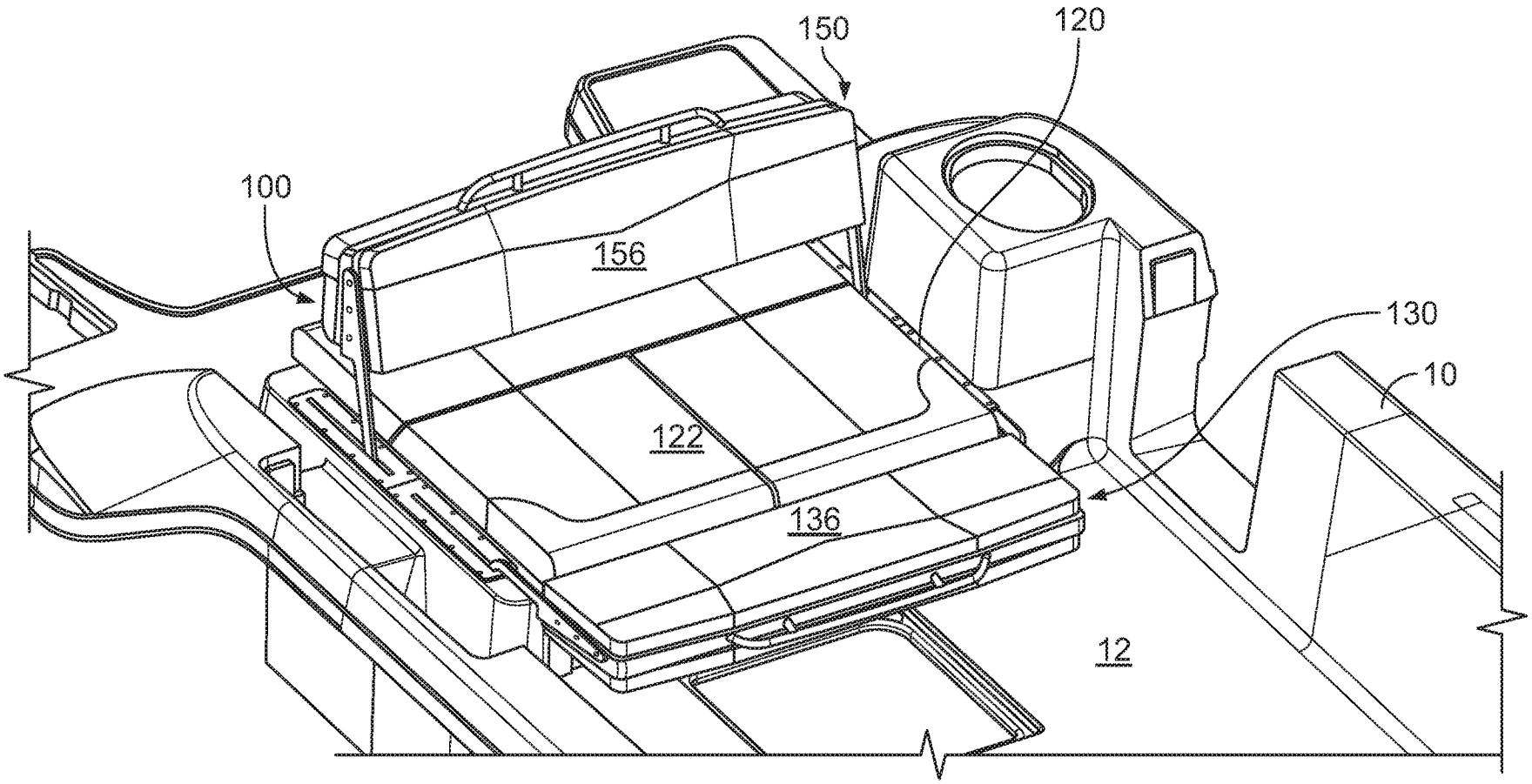
FIG. 5 is another perspective view of the boat-mounted seating assembly of FIG. 1. The seating assembly is configured as a forward-facing lounge seat arrangement.

Referring to FIG. 5, the seating assembly 100 can also be configured as a forward-facing lounge seat arrangement. In the forward-facing lounge seat arrangement, the second seat back member 150 is pivoted partially upward to provide a reclined backrest, and the first seat back member 130 is pivoted fully downward. The second seat back surface 136 and the upper seating surface 122 of the seat bottom 120 make up portions of a substantially planar surface. The third seat back surface 156 provides the reclined backrest surface. It should be understood that the second seat back member 150 can be pivoted to, and detained in, any desired location in relation to the seat bottom 120. Similarly, if the occupant(s) desires to elevate the feet area, the first seat back member 130 can be pivoted upward a little (e.g., about 5-10 degrees) to provide slight elevation.

Figure 6:
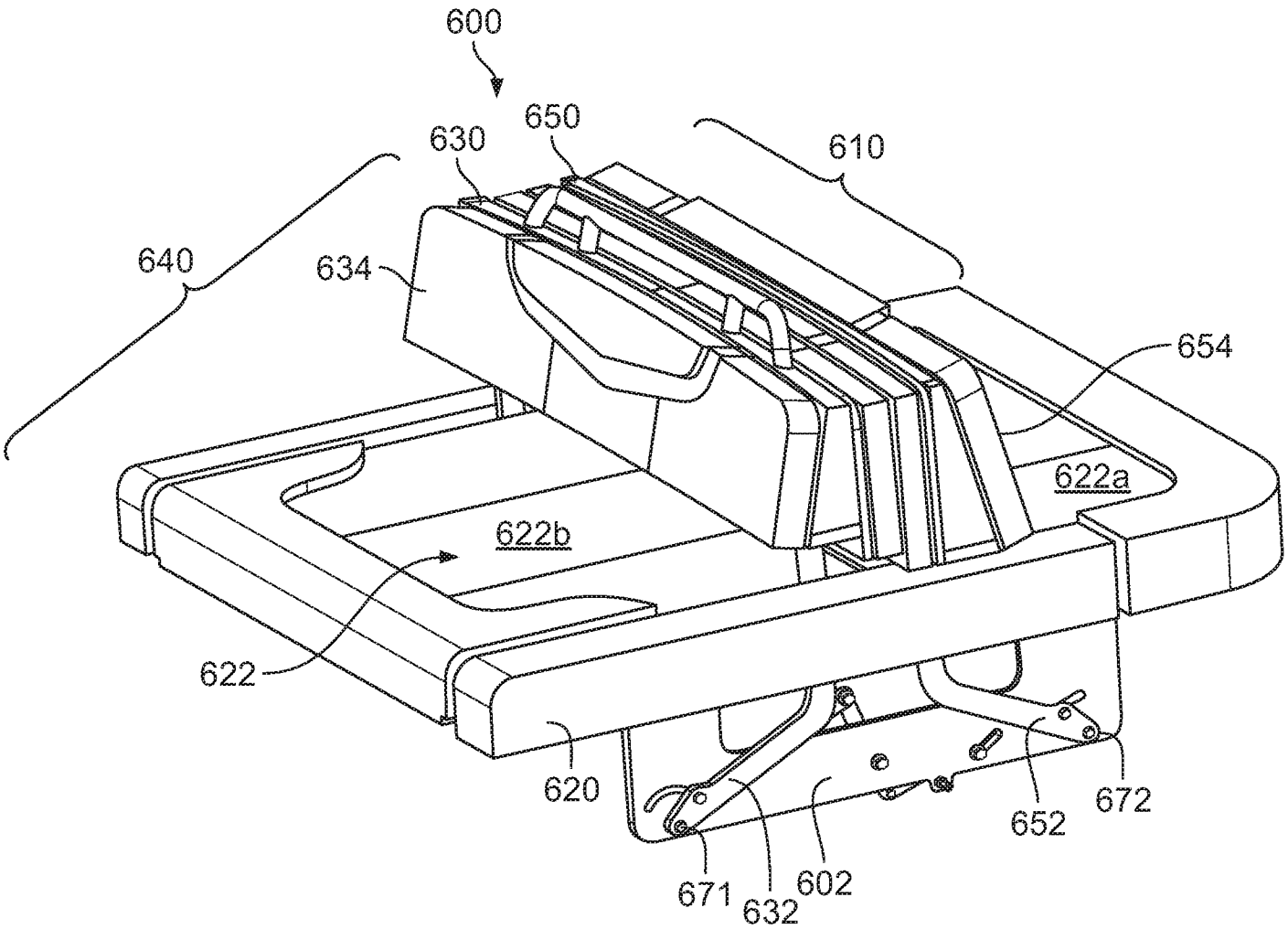
FIG. 6 is a perspective view of another seating assembly in accordance with some embodiments. The seating assembly is configured as back-to-back seats.

Referring to FIG. 6, a seating assembly 600 in accordance with some embodiments is shown. The seating assembly 600 is shown configured as back-to-back seats. The seating assembly 600 can be configured in multiple arrangements. In the depicted configuration, the seating assembly 600 is configured as a forward-facing seat 610 and a rearward-facing seat 640 that are arranged back-to-back. Hence, one or more occupants can be seated in the forward-facing seat 610 and one or more additional occupants can be seated in the rearward-facing seat 640, simultaneously if so desired.

The seating assembly 600 includes a seat bottom 620, a first seat back member 630, and a second seat back member 650. The seating assembly 600 includes a support structure 602. The support structure 602 supports the seating portions of the seating assembly 600, and mounts the seating assembly 600 to the deck 12 (FIG. 1). While only a single support structure 602 is visible in FIG. 6, it should be understood that a second support structure 602 is located on the other side of the seating assembly 600 so that the seating portions of the seating assembly 600 are rigidly supported. In some embodiments, the second support structure 602 (not visible) can be essentially a mirror-image of the visible support structure 602. Accordingly, as used herein, "support structure 602" refers to both of the support assemblies 602 collectively. In some embodiments, the support structure 602 is constructed of materials such as, but not limited to, stainless steel (e.g., SAE 316, etc.), aluminum, plated steel, composite materials, and the like, and combinations thereof.

As described further below, the first seat back member 630 is movable in relation to the seat bottom 620. Also, the second seat back member 650 is movable in relation to the seat bottom 620. Moreover, when first seat back member 630 is moved, the second seat back member 650 also moves (in relation to the seat bottom 620). The reverse is also true. That is, the second seat back member 650 can be moved to move the first seat back member 630 (in relation to the seat bottom 620).

The seat bottom 620 includes an upper seating surface 622. In particular, the seat bottom 620 includes a forward portion of the upper seating surface 622*a* and a rearward portion of the upper seating surface 622*b*. The forward portion of the upper seating surface 622*a* forms the forward-facing seat 610 along with the second seat back member 650. The rearward portion of the upper seating surface 622*b* forms the rearward-facing seat 640 along with the first seat back member 630.

In the depicted configuration, the first seat back member 630 and the second seat back member 650 are both located in their full upright positions such that the seating assembly 600 forms the back-to-back seats 610 and 640. From there, the first seat back member 630 can be moved rearward and downward until it is aligned with the seat bottom 620, and this causes the second seat back member 650 to be moved forward and downward away from the first seat back member 630.

The first seat back member 630 is movably coupled to the support structure 602 by a pair of first support arms 632 (only one support arm 632 of the pair of first support arms 632 is visible in FIG. 6). The second seat back member 650 is movably coupled to the support structure 602 by a pair of second support arms 652 (only one second support arm 652 of the pair of second support arms 652 is visible in FIG. 6). For simplicity sake, the support arms 632 and 652 will be described hereinafter in the context of a single support arm 632 or 652 in relation to a single side of the support structure 602. It should be understood, however, that the seating assembly 600 includes two such first support arms 632 and two such second support arms 652.

Figure 7:
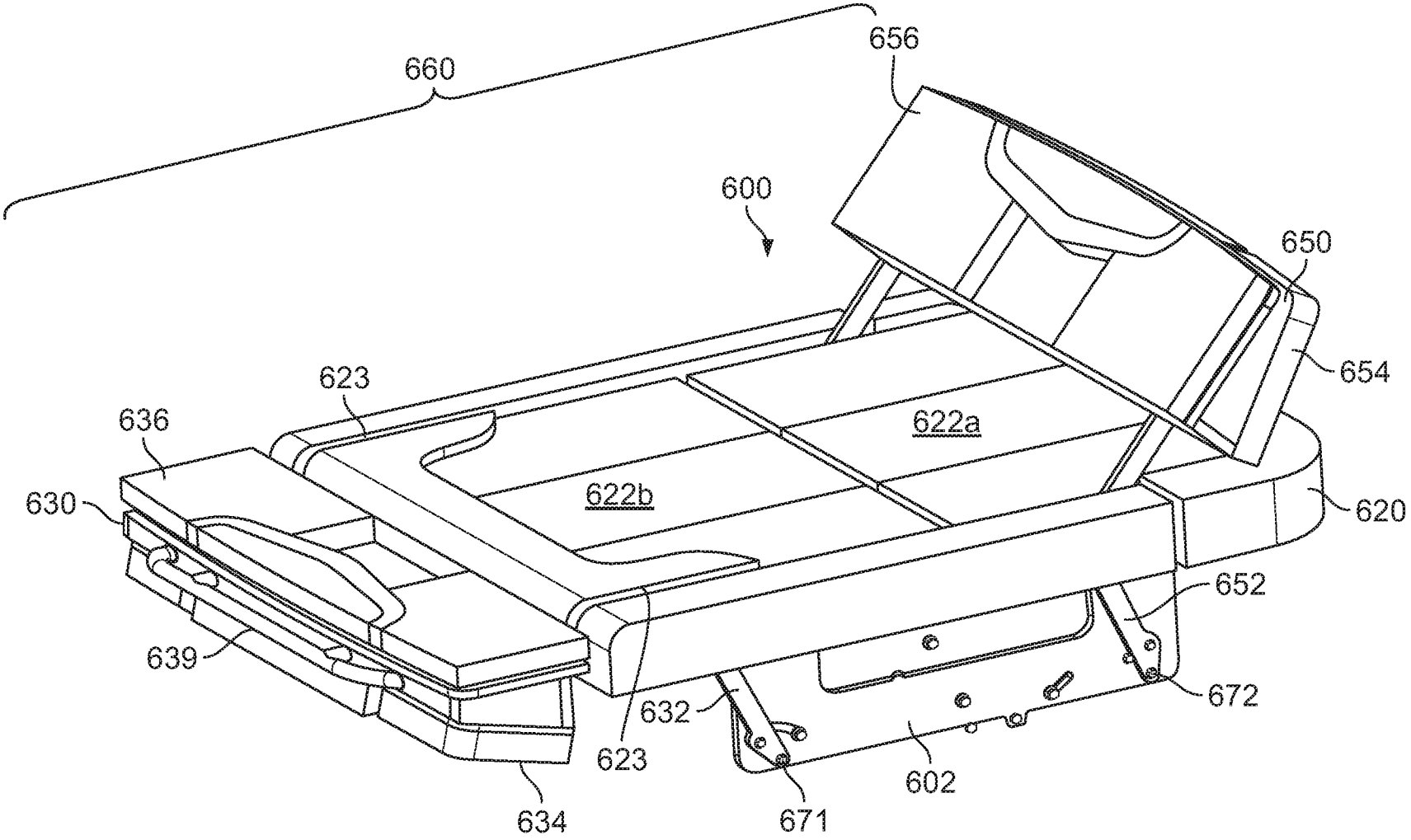
FIG. 7 is a perspective view of the seating assembly of FIG. 6 where the seating assembly is configured in a reclined seating position.

The first support arm 632 is attached to the first seat back member 630 and pivotally coupled to the support structure 602 at a point 671. The second support arm 652 is attached to the second seat back member 650 and pivotally coupled to the support structure 602 at a point 672. The first and second support arms 632, 652 are pivotally connected to the support structure 602 to enable the first and second seat back members 630, 650 to pivot about points 671 and 672, respectively. In addition, as described further below, a linkage assembly (or simply "linkage") couples the movements of the first and second support arms 632, 652, such that when the first seat back member 630 is moved from its upright position (the back-to-back position as shown) to the flat position (i.e., aligned with the seat bottom 620), the second seat member 650 is moved from its upright position to a reclined position (as shown in FIG. 7). In other words, by moving the first seat back member 630 and/or the second seat back member 650 to the reclined position, a rearward-facing reclining or lounging seating area is formed, as described further below.

The first seat back member 630 includes a first seat back surface 634 that faces rearward while the seating assembly 600 is configured as back-to-back seats (as shown in FIG. 6) and a second seat back surface 636 (shown in FIG. 7) that faces forward while the seating assembly 100 is configured as back-to-back seats. The second seat back member 650 includes a third seat back surface 656 (shown in FIG. 7) that faces rearward (e.g., against second seat back surface 636) while the seating assembly 600 is configured as back-to-back seats (as shown in FIG. 6) and a fourth seat back surface 654 that faces forward while the seating assembly 600 is configured as back-to-back seats.

When the seating assembly 600 is configured as back-to-back seats, the fourth seat back surface 654 and the forward portion of the upper seating surface 622*a* comprise the forward-facing seat 610. In addition, when the seating assembly 600 is configured as back-to-back seats, the first seat back surface 634 and the rearward portion of the upper seating surface 622*b* comprise the rearward-facing seat 140.

Referring to FIG. 7, the seating assembly 600 can also be configured as a reclined seat 660 (which also may be referred to a lounge seat). The reclined seat 660 is formed by the second seat back surface 636, the rearward portion of the upper seating surface 622*b*, at least some of the forward portion of the upper seating surface 622*a*, and the third seat back surface 656. In the orientation shown, the first seat back member 630 has pivoted about 90 degrees about the first pivot point 671, to move from the substantially upright position (FIG. 6) to a position where the second seat back surface 636 is aligned with the upper seating surface 622. Similarly, the second seat back member 650 has pivoted about 45 degrees about the second pivot point 672, to move from the substantially upright position (FIG. 6) to a position where the third seat back surface 656 is reclined about 135 degrees with respect to the upper seating surface 622. The seat bottom 620 includes channels 623 through which the first and second support arms 632, 652 pass during their movement.

In some embodiments, the first seat back member 630 is pivoted more or less than 90 degrees about the first pivot point 671, depending on the angles of the first and second seat back surfaces 634, 636, but generally pivots from an upright position to a position enabling the second seat back surface 636 to be an extension of the upper seating surface 622. Similarly, in some embodiments, the second seat back member 650 may pivot more or less than 45 degrees about the second pivot point 672, but generally less than 90 degrees if a reclined seat 660 is desired. In some examples, similar to the operation of the embodiments of FIGS. 1-5, both the first and second seat back members 630, 650 pivot about 90 degrees such that a flat sunbathing platform is created where both the second seat back surface 636 and the third seat back surface 656 form extensions of the upper seating surface 622.

In some examples, and as detailed above with respect to FIGS. 1-5, the movements of the first seat back member 630 and second seat back member 650 are driven by one or more actuators operatively coupled to the movement components of the seating assembly 600.

While in the depicted embodiment, the first seat back member 630 and the second seat back member 650 are pivotable to form a rearward-facing reclined seat 660, in some embodiments the first seat back member 630 and the second seat back member 650 can be movable in other ways, such as to form a forward-facing reclined seat or a flat sunbathing platform.

Figure 8A:
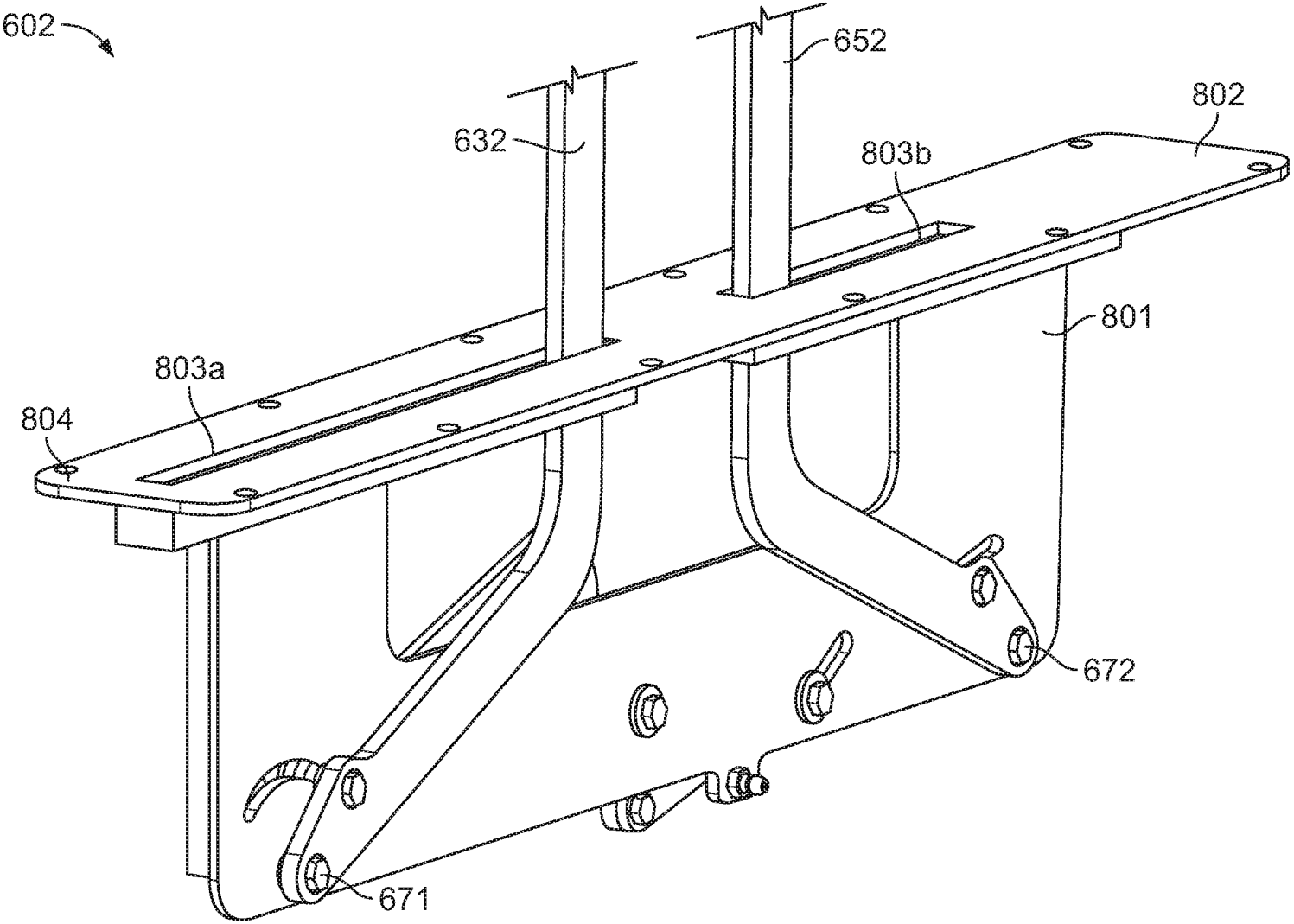
FIGS. 8A and 8B are perspective views of opposite sides of a support assembly of the seating assembly of FIG. 6.

Referring to FIG. 8A, the support structure 602 of the seating assembly 600 includes a vertical structure 801 attached to a horizontal structure 802. The horizontal structure 802 is configured to be attached to the underside of the seat bottom 620 (e.g., with fasteners though openings 804). The first and second support arms 632, 652 move though channels 803*a,b* in the horizontal support 802. The first and second support arms 632, 652 are pivotally attached to the vertical support 801 at the first and second pivot points 671, 672.

Figure 8B:
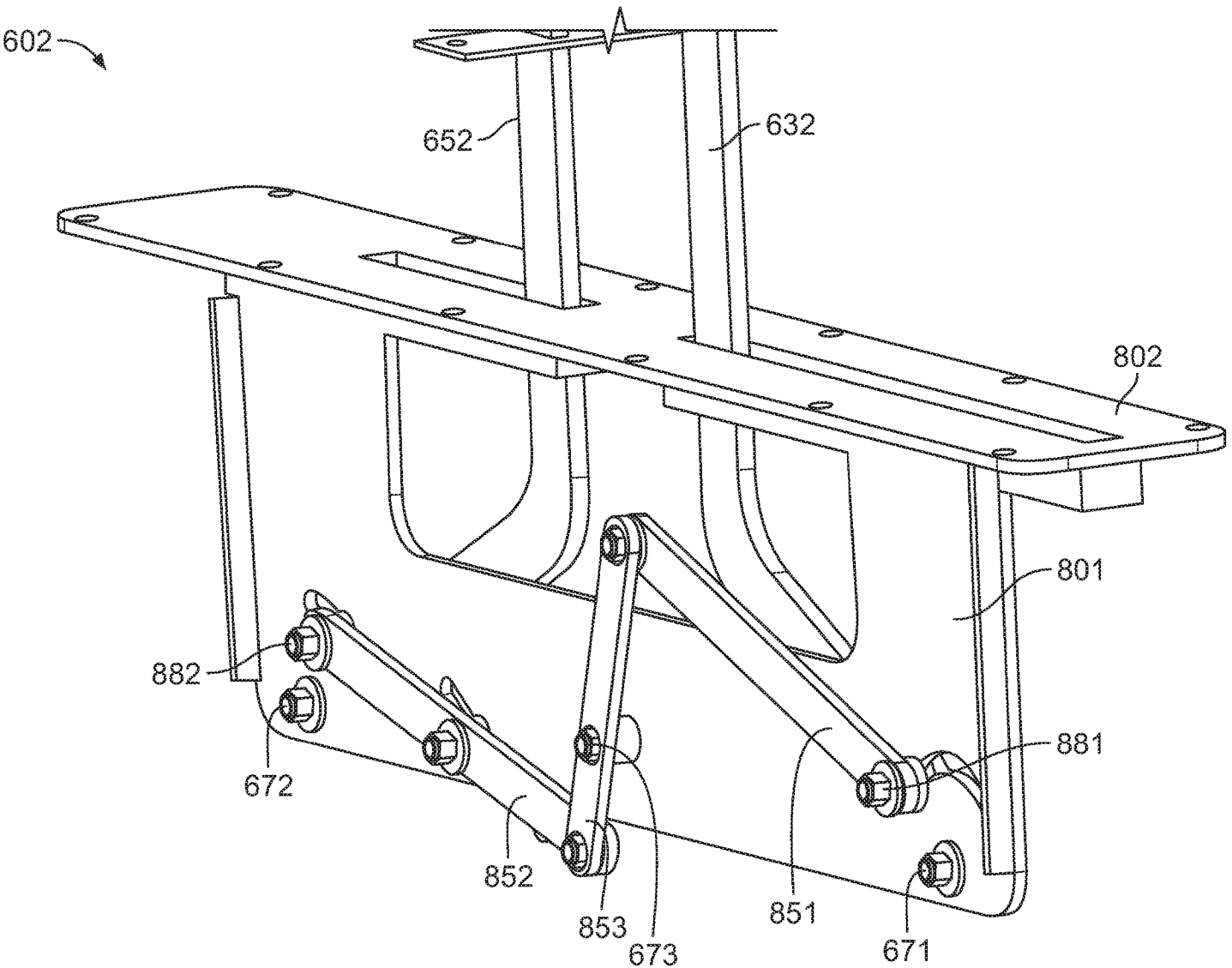

Referring to FIG. 8B (which shows the opposite side of the same support structure 602 shown in FIG. 8A), the seating assembly 600 also includes a first linkage 851, a second linkage 852, and a third linkage 853, which together couple the movements of the first and second support arms 632, 652. The first linkage 851 is attached to the first support arm 632 at a point 881 offset from the first pivot point 671. The second linkage 852 is attached to the second support arm 652 at a point 882 offset from the second pivot point 672. The third linkage 853 is attached to the first and second linkages 851, 852 and pivotally coupled to the vertical structure 801 at a third pivot point 673. As shown, the third pivot point 673 is offset from the center of the third linkage 853, such that one unit of rotation of the first support arm 632 about the first pivot point 671, results in less than one unit of rotation of the second support arm 652 about the second pivot point 672.

Figure 9A:
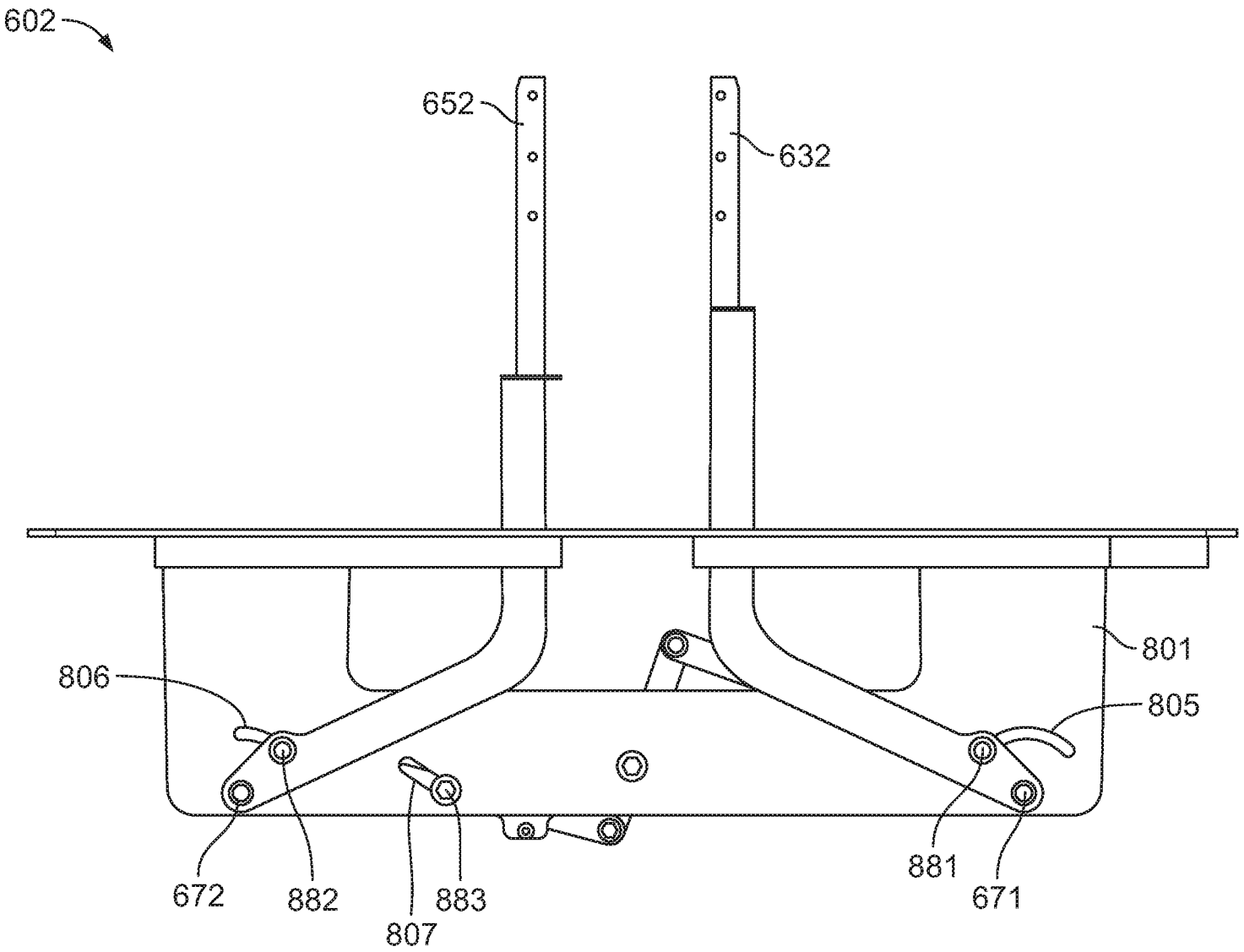
FIGS. 9A and 9B are side views of opposite sides of the support assembly of FIGS. 8A and 8B.
Figure 9B:
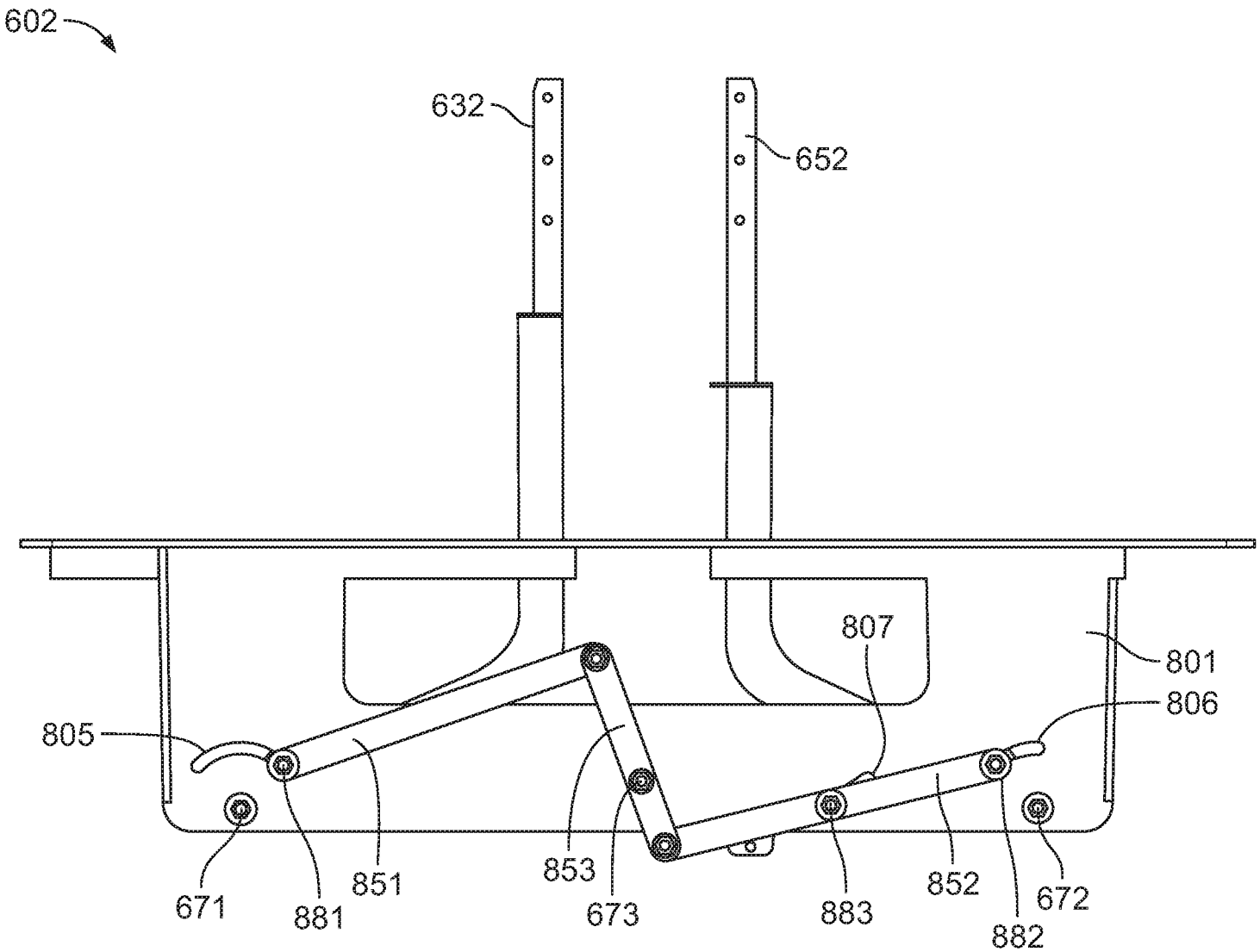

Referring to FIGS. 9A and 9B, the vertical support 801 of the support structure 602 defines a first arcuate slot 805 through which the first linkage 851 is connected to the first support arm 632 at point 881, and a second arcuate slot 806 through which the second linkage 852 is connected to the second support arm 632 at point 882. In some embodiments, the vertical support 801 also defines a third arcuate slot 807 through which a pin 883 moves, and the pin 883 is connected to the second linkage 852 to further stabilize the linkage 852 relative to the vertical support 801. In some instances, the pin 883 is connected to the first linkage 851 or the third linkage 853. In operation, the arcuate slots 805, 806 define a movement range of the first and second support arms 632, 652 by limiting the translational movements of the points 881, 882 within the arcuate slots 805, 806 to hard stops at the ends of the arcuate slots 805, 806. As shown, the first arcuate slot 805 allows about 90 degrees of rotation of the first support arm 632, and the second arcuate slot 806 allows about 45 degrees of rotation of the second support arm 652.

While this specification contains many specific implementation details, these should not be construed as limitations on the scope of any invention or of what may be claimed, but rather as descriptions of features, that may be specific to particular embodiments of particular inventions. Certain features that are described in this specification in the context of separate embodiments can also be implemented in combination in a single embodiment. Conversely, various features that are described in the context of a single embodiment can also be implemented in multiple embodiments separately or in any suitable subcombination. Moreover, although features may be described herein as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous. Moreover, the separation of various system modules and components in the embodiments described herein should not be understood as requiring such separation in all embodiments, and it should be understood that the described program components and systems can generally be integrated together in a single product or packaged into multiple products.

Particular embodiments of the subject matter have been described. Other embodiments are within the scope of the following claims. For example, the actions recited in the claims can be performed in a different order and still achieve desirable results. As one example, the processes depicted in the accompanying figures do not necessarily require the particular order shown, or sequential order, to achieve desirable results. In certain implementations, multitasking and parallel processing may be advantageous.

What is claimed is:

1. A watercraft seating assembly, comprising:

a seat bottom including an upper seating surface; and multiple seat back members that are reconfigurable between (i) an upright configuration forming back-to-back seats and (ii) a reclined configuration forming a reclined seat, the multiple seat back members including a first seat back member movable in relation to the seat bottom and a second seat back member movable in relation to the seat bottom, wherein:

while the multiple seat back members are forming the back-to-back seats, the first seat back member has a first seat back surface facing rearward and a second seat back surface facing forward;

while the multiple seat back members are forming the back-to-back seats, the second seat back member has a third seat back surface facing rearward and a fourth seat back surface facing forward;

while the multiple seat back members are forming the back-to-back seats, the second seat back surface faces the third seat back surface: and while the multiple seat back members are forming the reclined seat, the upper seating surface and the second seat back surface each comprise portions of a substantially flat surface, and the third seat back surface is arranged in a reclined position and defines an obtuse angle with respect to the substantially flat surface.

2. The seating assembly of claim 1, wherein the obtuse angle is 135 degrees.

3. The seating assembly of claim 1, wherein the first seat back member and the second seat back member are coupled together by a linkage such that movement of the first seat back member from the upright configuration to the reclined configuration causes a corresponding movement of the second seat back member from the upright configuration to the reclined configuration.

4. The seating assembly of claim 3, further comprising:

a support structure attached to the seat bottom;

a first support arm attached to the first seat back member and pivotally coupled to the support structure at a first point;

a second support arm attached to the second seat back member and pivotally coupled to the support structure at a second point;

a first linkage having a first end rotatably coupled to the first support arm at a location offset from the first point such that rotation of the first support arm about the first point moves the first end of the first linkage along an arc around the first point;

a second linkage having a first end rotatably coupled to the second support arm at a location offset from the second point such that rotation of the second support arm about the second point moves the first end of the second linkage along an arc around the second point; and a third linkage pivotally coupled to the support structure at a third point and comprising a first end coupled to a second end of the first linkage and a second end coupled to a second end of the second linkage, such that rotation of the first support arm about the first point causes rotation of the third linkage about the third point and rotation of the second support arm about the second point.

5. The seating assembly of claim 4, wherein the support structure defines:

a first arcuate slot through which the first linkage is rotatably coupled to the first support arm, the first slot defining the arc around the first point traveled by the first end of the first linkage, a first end of the first arcuate slot defining a stop corresponding to the upright configuration of the first seat back member and a second end of the first arcuate slot defining a stop corresponding to the reclined configuration of the first seat back member; and a second arcuate slot through which the second linkage is rotatably coupled to the second support arm, the second slot defining the arc around the second point traveled by the first end of the second linkage, a first end of the second arcuate slot defining a stop corresponding to the upright configuration of the second seat back member and a second end of the second arcuate slot defining a stop corresponding to the reclined configuration of the second seat back member.

6. The seating assembly of claim 5, wherein the support structure defines a third slot though which a pin coupled to one of the first, second, and third linkages travels during movement of the first and second seat back members.

7. The seating assembly of claim 3, wherein, in the upright configuration the first and second seat back members are in substantially vertical positions, and wherein, in the reclined configuration, the first seat back member is aligned with the upper seating surface and the second seat back member is angled away from the first seat back member.

8. The seating assembly of claim 7, wherein, in the reclined configuration, the second seat back surface is aligned with the upper seating surface and the third seat back surface defines an obtuse angle with respect to a portion of the upper seating surface between the first seat back member and the second seat back member.

9. The seating assembly of claim 7, wherein movement of the first seat back member from the upright configuration to the reclined configuration comprises a rotation of a first degree, and wherein movement of the second seat back member from the upright position to the reclined configuration comprises a rotation of a second degree, the second degree being less than the first degree.

10. The seating assembly of claim 9, wherein the first degree of rotation is at least 60 degrees, and wherein the second degree of rotation is less than 90 degrees.

11. The seating assembly of claim 10, wherein the first degree of rotation is about 90 degrees, and wherein the second degree of rotation is less than 75 degrees.

12. The seating assembly of claim 1, wherein, while the seating assembly is in the upright configuration, a rearward portion of the upper seating surface and the first seat back surface form a rearward-facing seat, and a forward portion of the upper seating surface and the fourth seat back surface form a forward-facing seat.

13. The seating assembly of claim 1, wherein the first seat back member and the second seat back member are movable in relation to the seat bottom independently of each other.

14. The seating assembly of claim 1, further comprising;

a first motorized actuator that pivots the first seat back member when the seating assembly is reconfiguring between the upright configuration and the reclined configuration; and a second motorized actuator that pivots the second seat back member when the seating assembly is reconfiguring between the upright configuration and the reclined configuration.

15. A watercraft, comprising:

a deck; and a seating assembly attached to the deck, the seating assembly comprising:

a seat bottom including an upper seating surface; and multiple seat back members that are reconfigurable between (i) an upright configuration forming back-to-back seats and (ii) a reclined configuration forming a reclined seat, the multiple seat back members including a first seat back member movable in relation to the seat bottom and a second seat back member movable in relation to the seat bottom, wherein:

while the multiple seat back members are forming the back-to-back seats, the first seat back member has a first seat back surface facing rearward and a second seat back surface facing forward;

while the multiple seat back members are forming the back-to-back seats, the second seat back member has a third seat back surface facing rearward and a fourth seat back surface facing forward; and while the multiple seat back members are forming the reclined seat, the upper seating surface and the second seat back surface each comprise portions of a substantially flat surface, and the third seat back surface is arranged in a reclined position and defines an obtuse angle with respect to the substantially flat surface.

16. The watercraft of claim 15, wherein the two back-to-back seats comprise a first seat that faces toward a front of the watercraft and a second seat that faces toward a rear of the watercraft.

17. The watercraft of claim 15, wherein the seating assembly extends laterally across a majority of a beam of the watercraft.

18. The watercraft of claim 15, wherein the first seat back member and the second seat back member are movable in relation to the seat bottom independently of each other.

19. The watercraft of claim 15, wherein the first seat back member and the second seat back member are coupled together by a linkage such that movement of the first seat back member from the upright configuration to the reclined configuration causes a corresponding movement of the second seat back member from the upright configuration to the reclined configuration.

* * * * *